US008302573B2

(12) United States Patent
Weber et al.

(10) Patent No.: US 8,302,573 B2
(45) Date of Patent: Nov. 6, 2012

(54) HYDRAULIC CAMSHAFT ADJUSTER HAVING AN AXIAL SCREW PLUG

(75) Inventors: Juergen Weber, Erlangen (DE); Stefan Schelter, Wilhelmsdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 368 days.

(21) Appl. No.: 12/706,434

(22) Filed: Feb. 16, 2010

(65) Prior Publication Data

US 2010/0242881 A1 Sep. 30, 2010

(30) Foreign Application Priority Data

Feb. 17, 2009 (DE) ..... 10 2009 009 252

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/160
See application file for complete search history.

(56) References Cited

U.S. PATENT DOCUMENTS 6,418,897 B1 * 7/2002 Urban et al. ..... 123/90.17

* cited by examiner

*Primary Examiner* — Ching Chang

(74) *Attorney, Agent, or Firm* — Lucas & Mercanti, LLP; Klaus P. Stoffel

(57) ABSTRACT

A hydraulic camshaft adjuster for an internal combustion engine. The hydraulic camshaft adjuster has a drive part that can be drive-connected to a crankshaft, an output part which has a central, first axial opening for the rotatably fixed connection to a first camshaft and is mounted such that it can be adjusted rotatably with respect to the drive part, a hydraulic actuating mechanism, by which a rotary angle position between the drive part and the output part can be adjusted, and a screw plug which is screwed to the drive part for closing the first axial opening. The screw plug is manufactured from a shaped part which is produced by a forming process without the removal of material.

15 Claims, 2 Drawing Sheets

HYDRAULIC CAMSHAFT ADJUSTER HAVING AN AXIAL SCREW PLUG

This application claims the priority of DE 10 2009 009 252.8 filed Feb. 17, 2009, which is incorporated by reference herein.

FIELD OF THE INVENTION

The invention lies in the technical field of internal combustion engines and relates to a hydraulic camshaft adjuster having an axial screw plug.

PRIOR ART

In internal combustion engines with mechanical valve control, gas exchange valves are actuated by the cams of a camshaft which is driven by a crankshaft, it also being possible to fix the control times of the valves via the arrangement and shape of the cams. The control times of the valves can be influenced via a change in the rotary angle position (phase relation) between the crankshaft and the camshaft as a function of the instantaneous operating state of the internal combustion engine, as a result of which advantageous effects can be achieved, such as a reduction in the fuel consumption and in the pollutant production. The use of specific apparatuses for adjusting the phase relation between the crankshaft and the camshaft, which are usually called "camshaft adjusters", is sufficiently well known.

In general, camshaft adjusters comprise a drive part which is drive-connected via a drive wheel to the crankshaft and an output part which is fixed to the camshaft, and an actuating mechanism which is connected between the drive part and the output part, which actuating mechanism transmits the torque from the drive part to the output part and makes it possible to adjust and fix the phase relation between the two.

In a hydraulic rotary piston adjuster, the drive part is configured as an outer rotor and the output part is configured as an inner rotor, the outer and inner rotor being arranged such that they can be adjusted rotatably with respect to one another and such that they are concentric with regard to a common rotational axis. At least one pressure space is formed by one of the two rotors in the radial intermediate space between the outer and inner rotors, into which pressure space a vane which is connected to the respective other rotor extends, as a result of which the pressure space is divided into a pair of pressure chambers which act counter to one another. The outer and inner rotors can be rotated relative to one another by targeted pressure loading of the pressure chambers, in order to bring about a change in the phase relation between the crankshaft and the camshaft as a result. Hydraulic rotary piston adjusters are described in detail, for example, in document's DE 202005008264 U1, EP 1596040 A2, DE 102005013141 A1, DE 19908934 A1 and WO 2006/039966 from the applicant.

In an established design, the inner rotor is provided with a central opening which is penetrated by a threaded screw ("central screw") which is screwed to an end-side threaded opening of the camshaft, in order to connect the inner rotor to the camshaft non-positively. Fastening of this type of the camshaft adjuster to the camshaft is disclosed, for example, in German application publication DE 102004038681 A1. Pressure medium, typically hydraulic oil from the lubricating oil circuit, can leak through the central opening.

OBJECT OF THE INVENTION

In contrast, it is the object of the present invention to provide a camshaft adjuster, by way of which escape of hydraulic medium through the central opening of the inner rotor can be avoided reliably and safely with relatively low costs in industrial series production.

ACHIEVEMENT OF THE OBJECT

According to the proposal of the invention, this and further objects are achieved by a hydraulic camshaft adjuster having the features described below. Advantageous embodiments of the invention are described below.

According to the invention, a hydraulic camshaft adjuster is shown, for example a rotary piston adjuster. The camshaft adjuster comprises a drive part, for example an outer rotor of a rotary piston adjuster, which can be drive-connected to a crankshaft, and an output part, for example an inner rotor of a rotary piston adjuster, which can be connected rotatably fixedly to a first camshaft, is mounted such that it can be adjusted rotatably with respect to the drive part in a concentric arrangement with regard to a common rotational axis, and the rotary angle position of which with respect to the drive part can be adjusted by means of a hydraulic actuating mechanism which comprises at least one pair of pressure chambers which act counter to one another. The output part is provided with a central, first axial opening for the rotatably fixed connection to the first camshaft, for example by means of a central screw.

Furthermore, the camshaft adjuster comprises an axial screw plug for closing the first axial opening, which screw plug is screwed to the drive part, for example via a shank section which has a thread.

According to the invention, the axial screw plug is manufactured from a shaped part which can comprise a shank section to be provided with a thread and an edge section which is formed integrally on said shank section. It is essential here that the shaped part is manufactured by a forming process without the removal of material from a blank part which is produced by cutting or punching. The thread for screwing to the drive part can be produced on the shaped part, for example, by means of a thread cutting process. It is likewise also possible to produce the screw plug from the shaped part by a forming process without the removal of material, by the thread being formed without the removal of material.

The screw plug of the camshaft adjuster can therefore be produced in a simple way for relatively low costs in industrial series production. In contrast to a production of the screw plug with the removal of material, for example by turning, which is associated with a comparatively high removal of material, material costs can be saved with the forming process without the removal of material.

According to one advantageous embodiment of the camshaft adjuster according to the invention, the screw plug comprises a shank section which is provided with a thread and an edge section which is formed integrally on the shank section, at least one sealing means for forming a seal being arranged between the edge section of the screw plug and the drive part. Here, it may be of advantage, in particular, if the edge section is provided with a first axial depression which is shaped as an undercut for receiving the sealing means. The first axial depression may be configured, for example, in the form of an annular groove, in which, for example, a rubber O-ring is received as sealing means. In an embodiment of this type of the camshaft adjuster according to the invention, the first axial depression which is formed as an undercut may be manufactured in a particularly inexpensive way by a forming process without the removal of material.

According to a further embodiment of the camshaft adjuster according to the invention, the sealing means is received in the first axial depression under a compressive prestress. The sealing means may, in particular, be prestressed against an outer wall face of the first axial depression in relation to a (radial, for example) spacing from the rotational axis of the first camshaft. This may take place, for example, in such a way that a rubber O-ring having defined excess dimensions is inserted into an annular groove. As a result of this measure, reliable fastening of the sealing means in the first axial depression may be achieved in an advantageous way, in order in this way to avoid the sealing means falling out during the assembly/dismantling of the camshaft adjuster. In contrast to a sealing means which is pulled, for example, onto an inner wall face of the first axial depression under tensile prestress, this can avoid the sealing means falling out of the first axial depression even in the case of temperature fluctuations, at which thermally induced material shrinking occurs.

According to a further embodiment of the camshaft adjuster according to the invention, a closest edge of the first axial depression in relation to the rotational axis of the first camshaft, is of rounded configuration. This measure can avoid damage to the sealing means during insertion into the first axial depression.

According to a further embodiment of the camshaft adjuster according to the invention, a transition section of the edge section, which transition section is situated between the shank section and the first axial depression, has an elastic deformability such that automatic release of the screw plug (in particular during operation of the internal combustion engine) is avoided by a reduction in a loss of prestressing force in the screw connection on account of settling and relaxation. As is known, in addition to the purely elastic deformations, plastic deformations which lead to loosening of a screw connection occur locally in the connection during and after assembly, even at loadings below the yield stress and/or interface pressure. Here, plastic flattening of, for example, surface roughnesses in the bearing faces and the loaded flanks of the paired thread is called "settling". Moreover, plastic flow of the materials can occur in a prestressed connection. The time-dependent loss in prestressing force caused by this is called "relaxation". The loss of the prestressing force of the screw assembly is compensated for by a sufficient elastic deformability of the transition section of the edge section of the screw plug.

According to a further embodiment of the camshaft adjuster according to the invention, that transition section of the edge section which is situated between the threaded shank and the first axial depression is provided with a second axial depression which is recessed in a mirror-inverted manner in the axial direction with respect to the first axial depression. This measure can advantageously achieve a reduction in the axial installation space which is required by the screw plug.

According to a further embodiment of the camshaft adjuster according to the invention, in which the drive part can be connected rotatably fixedly to a second camshaft which is mounted such that it can be adjusted rotatably with respect to the first camshaft, the drive part is provided, for the rotationally fixed connection to the second camshaft, with at least one second axial opening which is spaced apart radially from the first axial opening, the edge section of the screw plug being dimensioned in such a way that it covers the at least one second axial opening. This measure advantageously avoids escape of pressure medium out of the at least one second axial opening.

According to a further embodiment of the camshaft adjuster according to the invention, the screw plug is manufactured from sheet metal, for example steel or aluminum sheet, and/or plastic, which has the advantage of low manufacturing costs and ready formability.

According to a further embodiment of the camshaft adjuster according to the invention, the screw plug is manufactured from a shaped part which is produced by a forming process without the removal of material, by a casting process. As a result of this measure, the shaped part can be manufactured at relatively low cost in industrial series production.

Furthermore, the invention extends to an internal combustion engine which is provided with at least one camshaft adjuster as described above.

BRIEF DESCRIPTION OF THE DRAWINGS

The invention is now explained in greater detail using one exemplary embodiment, reference being made to the appended drawings. Identical or identically acting elements are denoted with the same designations in the drawings, in which.

DETAILED DESCRIPTION OF THE DRAWINGS

The figures schematically show one exemplary embodiment of the camshaft adjuster according to the invention. The camshaft adjuster according to the invention is configured by way of example in the form of a rotary piston adjuster 1 for the adjustment of a relative rotary angle position between two camshafts (inlet and outlet camshafts). Instead of a rotary piston adjuster, the invention could likewise be realized, for example, with an axial piston adjuster.

Figure 1:
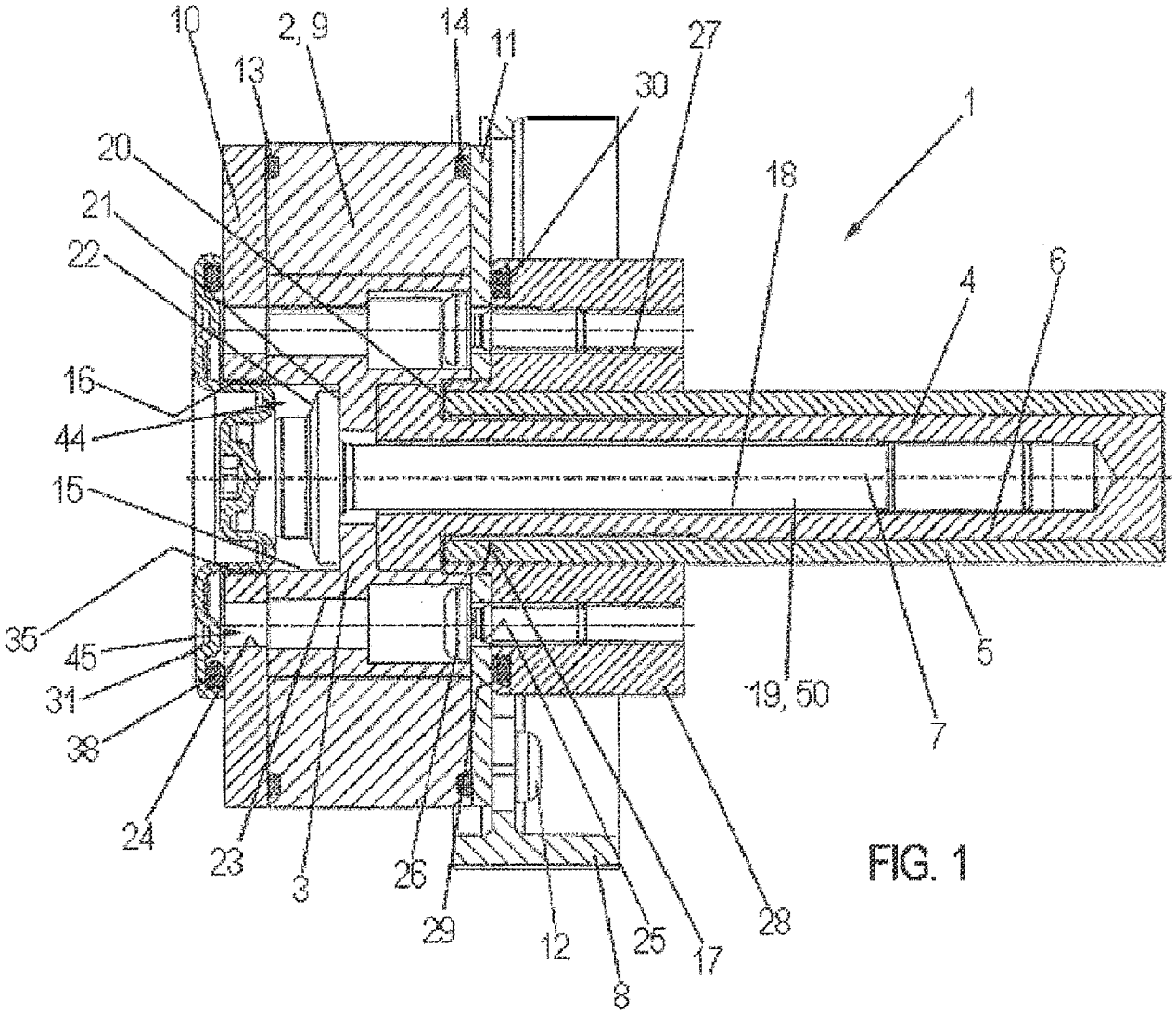
FIG. 1 shows an axial sectional view of one exemplary embodiment of the camshaft adjuster according to the invention with a screw plug.

As is shown in FIG. 1, a first camshaft 4 is accommodated in an axial cavity 6 of a second camshaft 5, the two camshafts 4, 5 being arranged in such a way that they can be adjusted rotatably with respect to one another concentrically about a common rotational axis 7.

The rotary piston adjuster 1 for adjusting a relative rotary angle position between the two camshafts 4, 5 comprises, as drive part, an outer rotor 2 which is drive-connected to a crankshaft (not shown) via a pulley 8 and a belt drive (not shown) and, as output part, an inner rotor 3 which is arranged with respect to the outer rotor 2 in such a way that it can be adjusted rotatably concentrically with respect to the latter. A plurality of pressure spaces (not shown) are formed in the radial intermediate space between the outer rotor and the inner rotor by a center part 9 of the outer rotor 2, into which pressure spaces in each case a vane extends which is connected to the inner rotor 3, as a result of which each pressure space is divided into a pair of pressure chambers which act counter to one another. A relative rotary angle position between the inner rotor 3 and the outer rotor 4 can be adjusted or fixed in a targeted manner by targeted pressure loading of the pressure chambers which act counter to one another. The exact method of operation of a hydraulic rotary piston adjuster 1 is sufficiently known to a person skilled in the art, for example, from the documents cited in the introduction, with the result that there is no need to describe it in greater detail here.

The outer rotor 2 forms a pressuretight housing for the inner rotor 3, the pressure chambers being closed axially in a pressuretight manner by a first side plate 10 and second side plate 11 arranged on the end side. The center part 9 and the two side plates 10, 11 are screwed to one another together with the pulley 8 by axial first fastening screws 12 which are distributed uniformly in the circumferential direction. For this purpose, the center part 9 of the outer rotor 2 and the second side plate 11 which is arranged on that side of the center part 9 which faces the camshaft are provided with axially aligned holes which are penetrated by the first fastening screws 12 which for their part are screwed to threaded holes of the first side plate 10 which is arranged on that side of the center part 9 which faces away from the camshaft, which is not shown in greater detail in FIG. 1. In each case first and second rubber O-rings 13, 14 are arranged between the two side plates 10, 11 and the center part 9 for forming seals for the fluidtight closure of the pressure chambers.

The inner rotor 3 is connected rotatably fixedly to the first camshaft 4. For this purpose, the inner rotor 3 is provided with a central inner rotor opening 15 which is formed at least approximately axially aligned to a central first side plate opening 16 of the first side plate 10 and to a central second side plate opening 17 of the second side plate 11. The inner rotor opening 15, the first side plate opening 16 and the second side plate opening 17 together form a central first axial opening 44 of the rotary piston adjuster 1. The inner rotor 3 is connected non-positively to a camshaft end face 20 of the first camshaft 4 by a central screw 19 which is received in the first axial opening 44 and is screwed with its threaded shank 50 into a central threaded hole 18 of the first camshaft 4. For this purpose, a circularly annular stop 21 which is clamped by a screw head 22 of the central screw 19 against the camshaft end face 20 of the first camshaft 4 is formed in the inner rotor opening 15.

The outer rotor 2 is connected rotatably fixedly to the second camshaft 5. For this purpose, the center part 9 of the outer rotor 2 is provided with a plurality of axial center part openings 23 which are arranged uniformly in the circumferential direction, and the two side plates 10, 11 are provided with third side plate openings 24 and fourth side plate openings 25 which are arranged such that they are aligned axially with the center part openings 23. The center part openings 23, third side plate openings 24 and fourth side plate openings 25 which are aligned with one another together form second axial openings 45 of the rotary piston adjuster 1 which are distributed in the circumferential direction. In each case axial second fastening screws 26 which are screwed together with threaded holes 27 of an annular flange 28 which is formed on the second camshaft 5 are received in the second axial openings 45. As a result, the second side plate 11 is connected non-positively to a flange end face 29 of the annular flange 28. A third rubber O-ring 30 is arranged between the annular flange 28 and the second side plate 11 for forming a seal for the pressuretight closure of the pressure chambers.

Figure 2C:
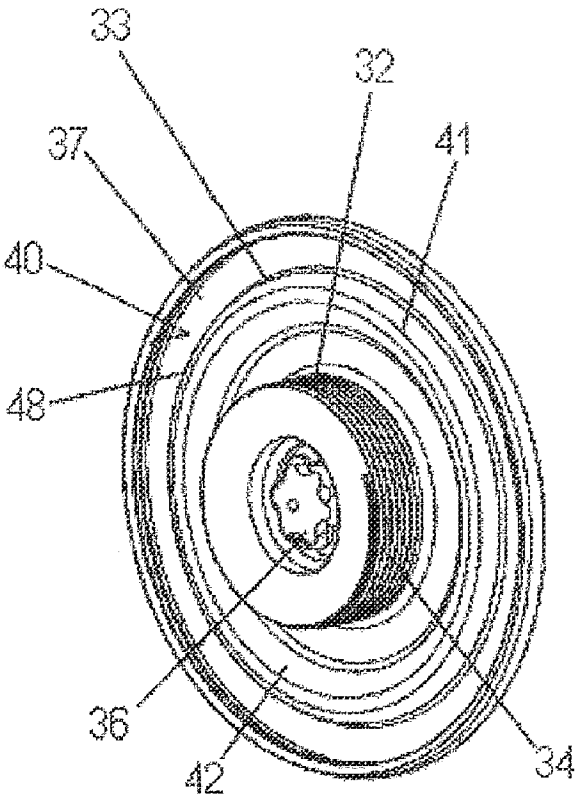
FIGS. 2A-2C show an axial sectional view (FIG. 2A) and two perspective views (FIGS. 2B, 2C) of the screw plug of the camshaft adjuster from FIG. 1.
Figure 2B:
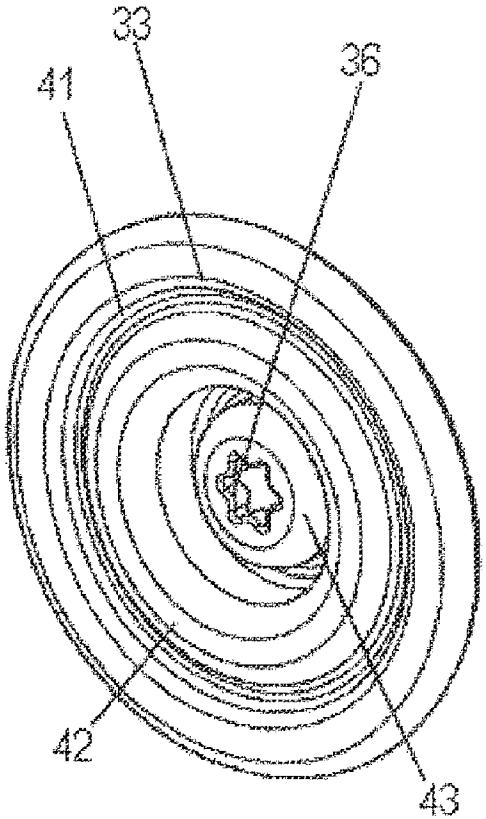
Figure 2A:
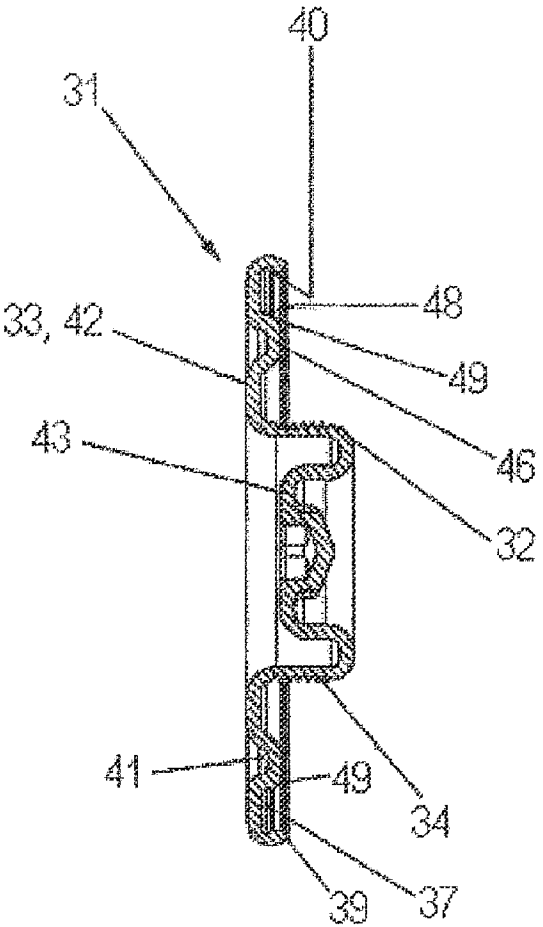

The central first axial opening 44 and the second axial openings 45 of the rotary piston adjuster 1 which are distributed in the circumferential direction are closed in a pressuretight manner by an axial screw plug 31. The screw plug 31 is shown in FIG. 2A in axial section and in FIGS. 2B and 2C in a perspective front and rear view.

Accordingly, the screw plug 31 comprises a shank section 32 which is shaped in its coarse form as a cylindrical sleeve, has an external thread 34 on its outer circumferential face, and on which an edge section 33 with a round outer contour is formed integrally. A screw driving profile 36 is formed into an axially pulled-in center section 43 of the shank section 32 with a depression which is mirror-inverted axially with respect to the shank section 32, which screw driving profile 36 is provided here, for example, with recesses arranged in a star shape and makes it possible for a correspondingly profiled screwdriver to engage, in order to turn the screw plug 31 in a desired rotational direction.

As is shown in FIG. 1, the screw plug 31 is screwed by way of its shank section 32 via the external thread 34 to an internal thread 35 which is formed in the first side plate opening 16 of the first side plate 10, as a result of which the central first axial opening 44 is closed axially to the outside. In the screwed-in state, the edge section 33 which is integrally formed on the shank section 32 additionally covers the second axial openings 45 of the rotary piston adjuster 1. In order to close the second axial openings 45 to the outside in a pressuretight manner, a fourth rubber O-ring 38 which is clamped between the edge section 33 and the first side plate 10 in the mounted state, is received in a first annular groove 37 which is shaped in the form of an undercut in the end region of the edge section 33. As can be seen from FIG. 2A, the first annular groove 37 is depressed in the axial direction in an at least approximately. U-shaped manner in axial section. Adjacent to the first annular groove 37, the edge section 33 is provided with a second annular groove 41 which is depressed axially in a mirror-inverted manner to the depression of the first annular groove 37, in an at least approximately U-shaped manner in axial section. The axial installation space required by the screw plug 31 can be reduced by the two annular grooves 37, 41 which are depressed in a mirror-inverted manner. In a corresponding way, the required axial installation space can be reduced by the axially pulled-in center section 43 of the shank section 32, with the result that a summary effect can be achieved by both measures.

An elastically deformable, annular transition section 42 is situated between the second annular groove 41 and the shank section 32, which transition section 42 has such a dimension in the radial direction that its elastic deformability prevents automatic release of the screw plug 31 by settling and relaxation of the screw connection (as explained in the introduction), in particular during operation of the internal combustion engine. In other words, this means that the radial dimension of the transition section 42 is selected in such a way that the edge section 33 can compensate for plastic deformations of the screw connection. At the same time, an increased contact pressure for the fourth rubber O-ring 38 onto the first side plate 10 can be achieved by the second annular groove 41 which is depressed in a mirror-inverted manner with respect to the first annular groove 37, with the result that a sufficient sealing action of the screw plug 31 is ensured.

As can be seen from FIG. 1, an end-side annular abutting edge 39 of the first annular groove 37 comes into contact with the first side plate 10 during tightening of the screw plug 31. Secondly, an annular outer face 46 of the groove bottom of the second annular groove 41 is spaced apart axially from the first side plate 10 in this position of the screw plug 31, with the result that the fourth rubber O-ring 38 can be clamped with a desired clamping force.

The fourth rubber O-ring 38 has a certain excess diameter dimension in comparison with the diameter of the first annular groove 37, with the result that it is received in the first annular groove 37 under compressive prestress. This has the consequence that the fourth rubber O-ring 38 is supported in the radial direction on a (radially) outer groove wall 40 of the first annular groove 37. In contrast to a rubber O-ring which is merely placed into the first annular groove 37 or a rubber O-ring which is clamped onto the inner groove wall 48 under tensile prestress, this measure has the advantage that the compressive prestress tends to rather increase in the case of thermally induced material shrinkage, with the result that the fourth rubber O-ring 38 falling out during the mounting/dismantling of the screw plug 31, which is probable in the other stated cases and can lead to undesired dealy of the production process in industrial series production, is avoided reliably.

In addition, an annular groove edge 49 of the inner groove wall 48 of the first annular groove 37 is rounded, with the result that damage to the rubber O-ring 38 which would be possible with an otherwise sharp edge can be avoided during insertion into the first annular groove 37.

The screw plug 31 is manufactured from sheet metal (for example, steel or aluminum sheet). A disk which serves as blank is produced in order to produce the screw plug 31, for example by being punched out of a sheet metal piece with the aid of a hollow punch. Subsequently, the sheet metal disk is subjected to a forming process without the removal of material, in which process the shank section 32 with the pulled-in center section 43 and the two annular grooves 37, 41 are manufactured, for example, by bending, stamping, die-depressing or rolling, as a result of which a shaped part is obtained. In particular, the first annular groove 37 which is formed as an undercut can be manufactured in a particularly simple and inexpensive way by a forming process without the removal of material in contrast to a process with the removal of material, such as turning. This is true particularly for the two annular grooves 37, 41 which are depressed axially in a mirror-inverted manner. Subsequently, the external thread 34 and the screw driving profile 36 are formed in the region of the shank section 32 of the shaped part which is obtained by the forming process, which can take place by a production process with and/or without the removal of material.

The above exemplary embodiment describes a rotary piston adjuster 1, the first axial opening 44 and second axial openings 45 of which are closed axially in a pressuretight manner by the screw plug 31. As a result of the production of the screw plug 31 from a shaped part which is produced from a disk-shaped sheet metal blank by means of a forming process without the removal of material, the screw plug 31 can be produced for relatively low production costs, in particular on account of the annular grooves 37, 41 which are formed as an undercut and can be produced only with difficulty by a process with the removal of material.

As a result of the (fourth) rubber O-ring 38 which is inserted into the first annular groove 37 under compressive prestress, the rubber O-ring can be prevented reliably from falling out even in the case of thermally induced material shrinkage. Instead, of a rubber O-ring, another sealing means could also be used which is fastened positively and/or non-positively and/or with a material-to-material fit in the first annular groove 37, for example a hardenable sealing means on a polymer basis. Furthermore, it would be conceivable to produce the screw plug 31 from a plastically deformable (for example, at higher temperature) plastic. Likewise, the shank section 32 of the screw plug 31 could be provided with an internal thread and the first side plate opening 16 of the first side plate 10 could be provided with an external thread. Moreover, the fourth rubber O-ring 38 could be received completely or at least partially in a recess of the first side plate 10.

LIST OF DESIGNATIONS

1 Rotary piston adjuster
2 Outer rotor
3 Inner rotor
4 First camshaft
5 Second camshaft
6 Cavity
7 Rotational axis
8 Pulley
9 Center part
10 First side plate
11 Second side plate
12 First fastening screw
13 First rubber O-ring
14 Second rubber O-ring
15 Inner rotor opening
16 First side plate opening
17 Second side plate opening
18 Threaded hole
19 Central screw
20 Camshaft end face
21 Stop
22 Screw head
23 Center part opening
24 Third side plate opening
25 Fourth side plate opening
26 Second fastening screw
27 Threaded hole
28 Annular flange
29 Flange end face
30 Third rubber O-ring
31 Screw plug
32 Shank section
33 Edge section
34 External thread
35 Internal thread
36 Screw driving profile
37 First annular groove
38 Fourth rubber O-ring
39 Abutting edge
40 Outer groove wall
41 Second annular groove
42 Transition section
43 Center section
44 First axial opening
45 Second axial opening
46 Outer face
48 Inner groove wall
49 Groove edge
50 Threaded shank

The invention claimed is:

1. A hydraulic camshaft adjuster for an internal combustion engine, comprising:

a drive part which can be drive-connected to a crankshaft;

an output part having a central, first axial opening for a rotatably fixed connection to a first camshaft and being mounted such that the output part can be adjusted rotatably with respect to the drive part;

a hydraulic actuating mechanism, by which a rotary angle position between the drive part and the output part can be adjusted; and a screw plug which is screwed to the drive part for closing the central, first axial opening, the screw plug being manufactured from a shaped part which is produced by a forming process without removal of material, wherein the screw plug comprises a shank section which has a thread and an edge section which is formed integrally on the shank section, and a sealing means that is arranged between the edge section and the drive part, the edge section has a first axial depression for receiving the sealing means, and a transition section of the edge section, which is situated between the shank section and the first axial depression, has an elastic deformability such that automatic release of the screw plug is avoided by a reduction in a loss of a prestressing force in a screw connection.

2. The camshaft adjuster of claim 1, wherein the screw plug is manufactured from the shaped part by a forming process without the removal of material.

3. The camshaft adjuster of claim 1, wherein the sealing means is received in the first axial depression under a compressive prestress.

4. The camshaft adjuster of claim 1, wherein a closest edge of the first axial depression to a rotational axis of the first camshaft is of rounded configuration.

5. The camshaft adjuster of claim 1, wherein the screw plug is manufactured from sheet metal and/or plastic.

6. The camshaft adjuster of claim 1, wherein the shaped part is cast and the screw plug is manufactured from the shaped part.

7. An internal combustion engine having at least one camshaft according to claim 1.

8. A hydraulic camshaft adjuster for an internal combustion engine, comprising:

a drive part which can be drive-connected to a crankshaft;

an output part having a central, first axial opening for a rotatably fixed connection to a first camshaft and being mounted such that the output part can be adjusted rotatably with respect to the drive part;

a hydraulic actuating mechanism, by which a rotary angle position between the drive part and the output part can be adjusted; and a screw plug which is screwed to the drive part for closing the central, first axial opening, the screw plug being manufactured from a shaped part which is produced by a forming process without removal of material, wherein the screw plug comprises a shank section which has a thread and an edge section which is formed integrally on the shank section, and a sealing means that is arranged between the edge section and the drive part, the edge section has a first axial depression for receiving the sealing means, and the edge section has a second axial depression which is recessed in a mirror-inverted manner in an axial direction with respect to the first axial depression.

9. The camshaft adjuster of claim 8, wherein the sealing means is received in the first axial depression under a compressive prestress.

10. The camshaft adjuster of claim 8, wherein a closest edge of the first axial depression to a rotational axis of the first camshaft is of rounded configuration.

11. The camshaft adjuster of claim 8, wherein the screw plug is manufactured from sheet metal and/or plastic.

12. The camshaft adjuster of claim 8, wherein the shaped part is cast and the screw plug is manufactured from the shaped part.

13. A hydraulic camshaft adjuster for an internal combustion engine, comprising:

a drive part which can be drive-connected to a crankshaft;

an output part having a central, first axial opening for a rotatably fixed connection to a first camshaft and being mounted such that the output part can be adjusted rotatably with respect to the drive part;

a hydraulic actuating mechanism, by which a rotary angle position between the drive part and the output part can be adjusted; and a screw plug which is screwed to the drive part for closing the central, first axial opening, the screw plug being manufactured from a shaped part which is produced by a forming process without removal of material, wherein the drive part can be connected rotatably fixedly to a second camshaft which is mounted such that the second camshaft can be adjusted rotatably with respect to the first camshaft, the drive part being provided, for the rotatably fixed connection to the second camshaft, with at least one second axial opening which is spaced apart radially from the central, first axial opening, an edge section of the screw plug covering the second axial opening.

14. The camshaft adjuster of claim 13, wherein the screw plug is manufactured from sheet metal and/or plastic.

15. The camshaft adjuster of claim 13, wherein the shaped part is cast and the screw plug is manufactured from the shaped part.

* * * * *